United States Patent [19]

Hanyu et al.

[11] Patent Number: 4,565,143

[45] Date of Patent: Jan. 21, 1986

[54] METHOD OF AUTOMATICALLY ADJUSTING THREAD TENSION IN A SEWING MACHINE

[75] Inventors: Susumu Hanyu; Kenji Kato; Kazumasa Hara, all of Tokyo, Japan

[73] Assignee: Janome Sewing Machine Co., Ltd., Tokyo, Japan

[21] Appl. No.: 573,565

[22] Filed: Jan. 25, 1984

[30] Foreign Application Priority Data

Feb. 1, 1983 [JP] Japan ..... 58-13687

[51] Int. Cl.[4] ..... D05B 47/04

[52] U.S. Cl. ..... 112/262.1; 112/254; 112/272

[58] Field of Search ..... 112/254, 262.1, 255, 112/272, 273, 277, 278, 121.11, 158 E, 222, 453

[56] References Cited

U.S. PATENT DOCUMENTS

| | | | |
|---|---|---|---|
| 4,170,951 | 10/1979 | Dobrjanskyj | 112/278 |
| 4,301,757 | 11/1981 | Tonomura | 112/254 |
| 4,331,089 | 5/1982 | Widmer | 112/158 E X |
| 4,370,938 | 2/1983 | Bergvall | 112/158 E |
| 4,377,980 | 3/1983 | Hanyu et al. | 112/254 |

FOREIGN PATENT DOCUMENTS

| | | | |
|---|---|---|---|
| 59-22595 | 2/1984 | Japan | 112/272 |

*Primary Examiner*—Peter Nerbun

*Attorney, Agent, or Firm*—Michael J. Striker

[57] ABSTRACT

A method of automatically adjusting thread tension in a sewing machine including detecting changes of load subjected on the needle bar caused when the needle penetrates the fabric to be sewn and adjusting the electric driving part of the thread tension device in accordance with the values of the changing components of the load.

4 Claims, 5 Drawing Figures

METHOD OF AUTOMATICALLY ADJUSTING THREAD TENSION IN A SEWING MACHINE

BACKGROUND OF THE INVENTION

The present invention relates to a method of automatically adjusting thread tension in a sewing machine.

The prior art belonging to this field will be explained in reference to the attached drawings. With respect to the thread tension, taking the tension of the upper thread, for example, it is preferable to make adjustments for thin fabric materials, middle materials and thick materials in proper ranges of the thread tension as shown with arrows in FIG. 1. It is in general required to increase the tension as thickness of the fabric becomes large and as hardness becomes high.

For automatically responding to these characteristics of the fabric, there has been proposed an adjustment of an electric driving part of the thread tension device in accordance with the data of the fabric thickness. However, for the fabric hardness, there have not been any measures.

SUMMARY OF THE INVENTION

This invention is to adjust the thread tension in response to load subjected on a needle bar when a needle penetrates the fabric material, thereby to automatically provide exact thread tension.

The load is detected by the premise that the load is relative to the characteristics of the fabric thickness and hardness. The detection is made in that electric current of the load on a motor driving a main shaft of the sewing machine is momentarily increased at the penetration, or in that an electric driving part of the thread tension device is controlled by deviation signals expressed with deviation between ordinary speed designating signals (corresponding to objective values of the speed) and speed feedback signals (corresponding to surveyed values of the speed), or by signals from a stress detector provided on the needle bar or others.

DETAILED DESCRIPTION OF THE PREFERRED EMBODIMENTS

Figure 2:
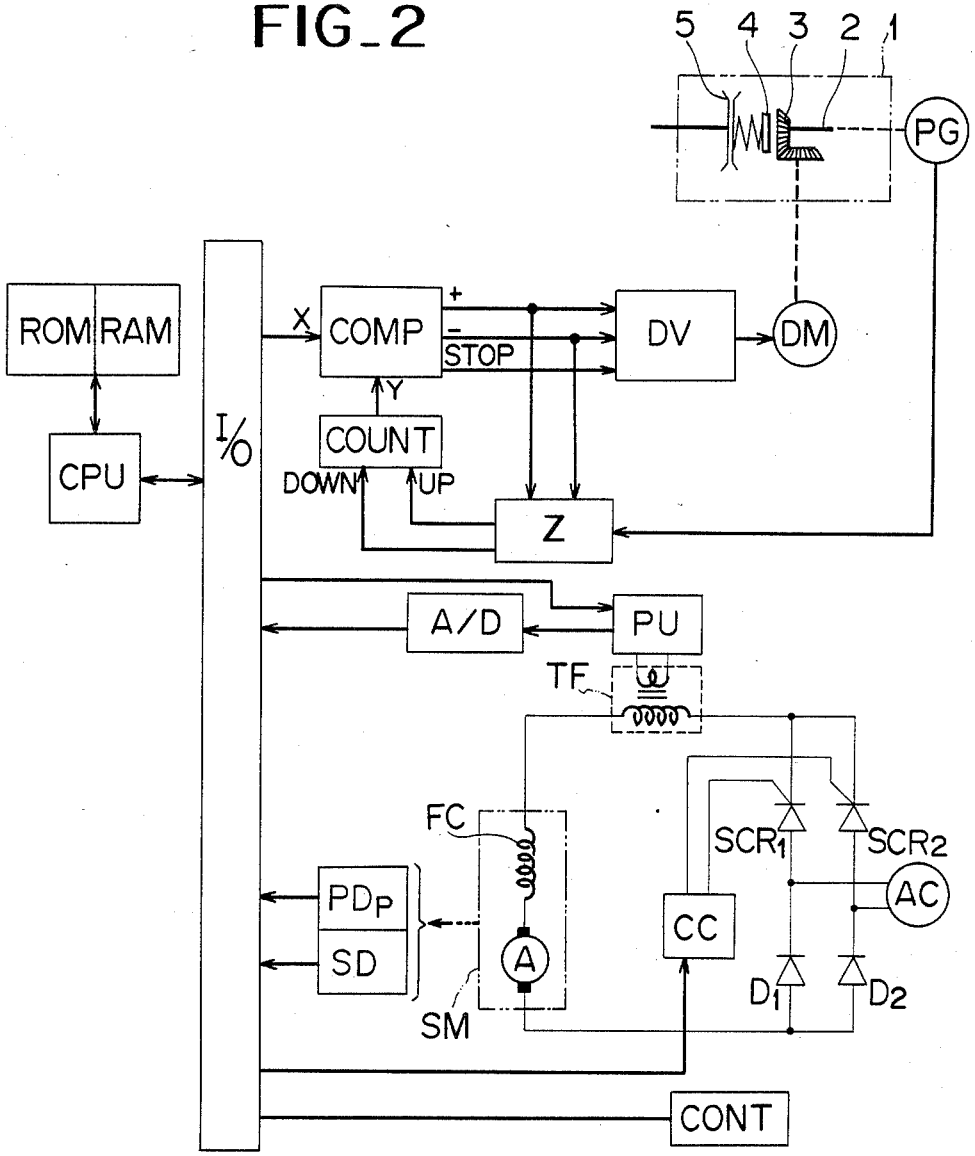
FIG. 2 shows a control circuit of an embodiment of the present invention.

In FIG. 2, a microcomputer is composed of a central processing unit (CPU), a read-only-memory (ROM), a read-access-memory (RAM) and an input-output port (I/O).

The sewing machine is, though not shown, provided with a driving part for controlling stitchings, which is controlled by the above mentioned microcomputer for producing desired stitching patterns. A motor (SM) for driving a main shaft of the sewing machine is provided with an armature (A) and a series field (FC), and is connected to a commercial power source (AC). The load current is effected with a full wave phase control by mixed bridge comprising diodes (D1)(D2) and thyristors (SCR1) (SCR2).

A gate controller (CC) makes an ignition phase control on the thyristors (SCR1) (SCR2) in accordance with signals processed as later mentioned from the central processing unit (CPU). A machine controller (CONT) designates the speed of the main shaft driving motor (SM), and gives digitalized designation signals to the central processing unit (CPU). A speed detector (SD) is provided on the main shaft (not shown) of the sewing machine for issuing and giving pulse signals of numbers in proportion to the rotation speed of the main shaft to the central processing unit (CPU), and feeding back the speed signal.

Figure 3:
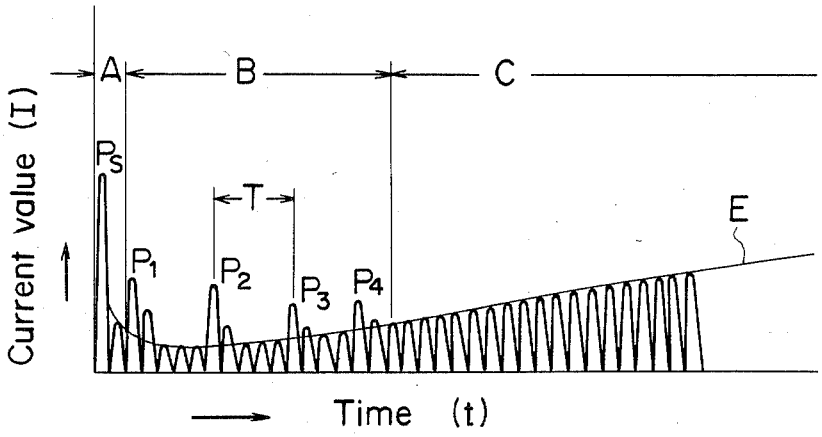
FIG. 3 shows waves of current of load on a motor (MS) driving a main shaft of a sewing machine in the control circuit of FIG. 2.

A transformer (TF) for detecting the load current supplies the current wave of the main shaft driving motor (SM) to a pick-up circuit (PU) and transmits the waves of the full wave controlled currents as shown in FIG. 3 for driving the sewing machine. The pick-up circuit (PU) rectifies the input signal wave in accordance with an order from the central processing unit (CPU) and holds peak values (P1) (P2) (P3) (P4) shown in FIG. 3 which are produced when the needle passes the fabric, and issues a read order of peak hold in synchronism with the phase penetrating the needle through the fabric, in response to the signal of a detector (PDp) of needle moving phase provided on the main shaft of the sewing machine.

Analog-digital converter (A/D) converts the peak hold value into a digital signal, and supplies it to the central processing unit (CPU). DC motor (DM) is controlled by a driver (DV) to adjust the upper thread tension effected by a thread tension device 1, and rotates a gear 3 secured on a thread shaft 2 to axially move an actuator 4 screwed on the shaft 2 for controlling the pressure exerted by thread tension discs 5 holding a thread. The driver (DV) rotates DC motor (DM) forward and backward and stops it in response to signals (+)(−) and (STOP) issued from a comparison circuit (COMP) for the period of issuing the signals.

A pulse generator (PG) issues pulse signals in proportion to the rotation or the rotation phase angle of the shaft 2, and and supplies these signals to a polarity discriminating circuit (Z). In combination of the signals (+)(−) of the comparison circuit (COMP) and the signals of the pulse generator (PG), and when the combination is the signal (+), the circuit (Z) counts up (UP) counting of a counter (COUNT) per each of the signals from the pulse generator (PG), and when it is the signal (−), the circuit (Z) counts down (DOWN).

The comparison circuit (COMP) is supplied with digital data for setting the thread tension at the starting of the sewing machine when the control power source is supplied, or digital data for setting the thread tension during driving of the sewing machine (called "thread tension designation data X" hereinafter) from the central processing unit (CPU), and the comparison circuit is supplied with the counting data for setting the thread tension at the starting of the driving of the sewing machine when the control power source is supplied, or the counter data counted by this data (called "counting data Y" hereinafter), from the counter (COUNT). These data X and Y are compared, and the case of $Y<X$, the signal (+) is the output, and in the case of $Y>X$, the signal (−) is output, and in the case of $Y=X$, the signal (STOP) is the output.

The next explanation will be concerned with actuation of the above mentioned structure. When the control electric source is supplied, the control circuit shown in FIG. 2 starts to work. The comparison circuit (COMP) is supplied with binary data 0 0 0 0 as an initial value of the data X from the central processing unit (CPU), and supplied with binary data 1 1 1 1 as an initial value from the counter (COUNT). Since Y>X is obtained, the comparison circuit (COMP) issues an output of the signal (−) to the driver (DV), so that the DC motor (DM) is reversely rotated and the actuator 4 of the thread tension device 1 is moved to the right side in FIG. 2 to loosen the thread tension.

The counter (COUNT) is successively counted down, and when Y=X is obtained the comparison circuit (COMP) outputs the signal (STOP) and the DC motor (DM) is stopped. During this period the actuator 4 engages a stopper (not shown) and stops at a scale 0 of the thread tension. The DC motor (DM) is idle in rotation after engagement, and the initial setting is finished by this stopping. On the standard of the initial setting position where the thread tension device 1 of X at the finishing being 0 0 0 0 and the DC motor (DM) are combined, the following thread tension is controlled.

Subsequently, the central processing unit (CPU) issues a determined value, e.g., X=0 0 1 0, as a standard setting value of the thread tension. When Y<X is obtained, the comparison circuit (COMP) outputs the signal (+), so that the DC motor (DM) is normally rotated and the actuator 4 moves to the left in FIG. 2 to increase the thread tension. When the counter (COUNT) is counted up by 2, Y=X is obtained and the DC motor (DM) is stopped. The thread tension at this time of the thread tension device 1 is set at the standard.

The fabric is set on the sewing machine and the machine controller (CONT) is operated to drive the sewing machine by designating, e.g., the low speed. The current waves of the load effected with the full wave control of the motor (SM), which is given to the pick-up circuit (PU) via the transformer (TF), are as shown in FIG. 3. Since friction resistance is large when the sewing machine starts to rotate, the load of the needle bar is increased and current value (I) becomes remarkably large to generate a peak (Ps) at the beginning of rotation. Since the friction resistance is decreased as time (t) passes, an evnelope (E) of the waves effected with the full wave control rapidly falls. After passing a transient period (A), the rotation speed of the sewing machine goes up as the time (t) passes by successively moving from the low speed designation to the high speed designation by means of the controller (CONT) and the envelope (E) also goes up. When the needle passes through the fabric per each of the rotation period (T) in an interval (B) of relatively low speed, the load of the needle momentarily increases due to the friction resistance, so that the current of the load increases accordingly and each of the peak values (P1) (P2) (P3) (P4) appears. The larger are these peak values, the thicker and the harder is the fabric. When the rotation speed of the sewing machine becomes higher, and enters an interval (C) of relatively higher rotation speed, these peak values do not appear, even if the load of the needle bar increases momentarily by inertia of the rotation, because the rotation speed of the sewing machine is equalized so that the load of the motor driving the main shaft is hardly changed.

As is seen from the above, in this invention, a calculation is made on each of the peak values (P1) to (P4) in the interval (B) having interrelation with the fabric characteristics, and the thread tension is controlled with the results of this calculation.

The pick-up circuit (PU) outputs the peak values (P1) to (P4) whose peaks are held, and these values are converted into the digital values by means of the analog-digital converter (A/D) and given to the central processing unit (CPU). The central processing unit (CPU) makes a calculation in the interval (A) for starting rotation of one or two stitchings by means of the signal from a speed detector (SD), and does not adopt the peak (Ps). Thus, the stitching is begun at the thread tension which has been in advance determined at the standard. The thread tension is not required to be of a high precision at the beginning of rotation.

The peak values (P1) to (P4) in the interval (B) of the normal low rotation are amended by the central processing unit (CPU), or judged successively as to whether the normal values or noises, or calculated to obtain mutual average values, so that these results are stored in the random-access-memory (RAM) as data ranking the fabric characteristics and are re-written appropriately.

The read-only-memory (ROM) stores the data X of designating the thread tension in response to the data of the fabric characteristics, and the data X are newly output instead of X=0 0 1 0. If the new data X is different from the previous condition, and since it is different from the counting data Y from the counter (COUNT), the comparison circuit (COMP) actuates and the thread tension device 1 is controlled to the thread tension based on a new data X. In the interval (C) of the comparatively high speed, the central processing unit (CPU) makes the calculation from the speed signal and does not adopt each of the peak values, but adopts the last data X in the interval (B), so that the thread tension based on this data is maintained, while the controlling electric source is continuously supplied the last data X is adopted also in the interval (A), so that this thread tension is maintained.

A further reference will be made to another embodiment where the thread tension is controlled by detecting the load of the needle bar not depending on the load electric current but depending on the speed controlling signal of the motor driving the main shaft of the sewing machine.

Figure 4:
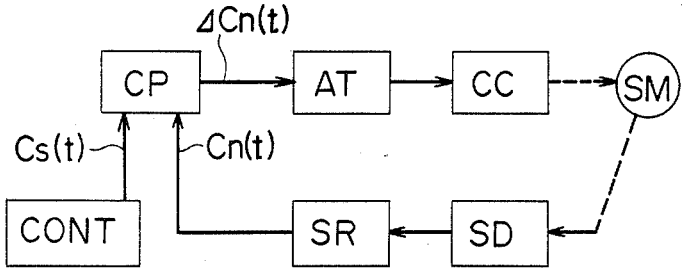
FIG. 4 is a block diagram of the speed control in the control circuit of FIG. 2.

In the control circuit in FIG. 2, a speed control system of the motor (SM) driving the main shaft of the sewing machine may be simplified as shown in FIG. 4. A digital signal Cs(t) (t is for time) corresponding to the speed objective value is supplied to one of the terminals of the comparator (CP). The rotation period calculator (SR) counts the signal of the speed detector (SD), and supplies to the other terminal of the comparator (CP) the digital signal Cn(t) based on the counting value per unit time of the counted signal. The comparator (CP) compares these digital signals, and deviation signal $\Delta Cn(t)=Cs(t)-Cn(t)$ is calculated per each small period of time t and gives it to an ignition time calculator (AT).

The ignition time calculator (AT) amends a new ignition phase in accordance with the deviation signal $\Delta Cn(t)$ with respect to the present ignition phase for the gate controller (CC), and produces a negative feedback in order to lower the next deviation signal $\Delta Cn(t)$. In the present invention, this deviation signal $\Delta Cn(t)$ is amended in the speed similarly as in the previous embodiment and is stored as the data ranking fabric characteristics in the random-access-memory (RAM). If the rotation of the sewing machine rapidly decreases concerning the speed designation due to the rapid increase of the load of the sewing machine or for other reasons, the deviation signal $\Delta Cn(t)$ increases to amend this rapid decrease as the peak values (P1) to (p4) in FIG. 3. In such a manner, the data X for designating the thread tension in response to the data of the fabric characteristics is stored in this embodiment, so that the thread tension is controlled as mentioned above. The present case does not need the transformer (TF) and the pick-up circuit (PU).

Figure 1:
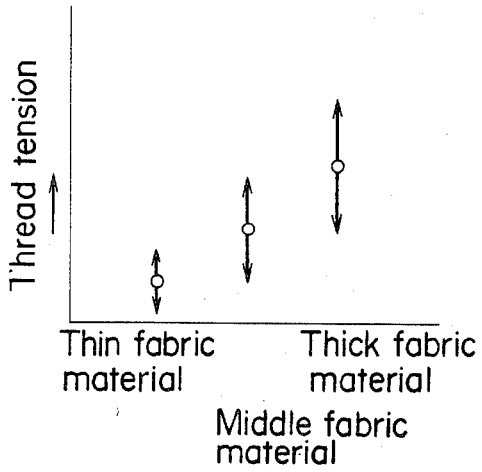
FIG. 1 shows the relationship between the thickness of the fabric and the proper thread tension.
Figure 5:
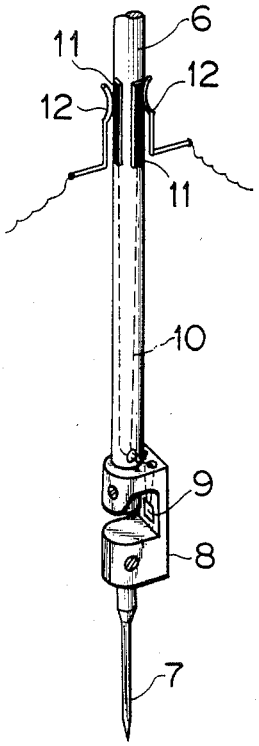
FIG. 5 is a perspective view showing the attachment of a stress detector to a needle bar.

A further explanation will be made to a method of adjusting the thread tension by detecting the load on the needle bar by means of a stress detector. In FIG. 5, the needle bar 6 is secured with an elastic member 8 of U shape serving to hold the needle 7 and is provided with a stress gauge 9 in a bottom of an inner side. With respect to the stress gauge 9, leads 10 pass through the hollow needle bar 6 and reach sliding plates 12 which are insulated from each other. Brushes 11 contacting the sliding plate 12 issue detected values, and these values are amplified or digital-converted and given to the central processing unit (CPU). The stress gauge 9 detects the stress of the elastic member 8 when the needle 7 penetrates the fabric, and the detected data are stored in the random-access-memory (RAM) as data ranking the fabric characteristics. The data X for designating the thread tension in response to the data of the fabric characteristics are read out to adjust the thread tension. This case adopts all of the detected data all over the intervals (A), (B), (C).

As having mentioned above, according to the invention, the fabric characteristics concerning the thread tension are detected with respect to the thickness and hardness of the fabric to automatically adjust the thread tension without being troublesome, so that the thread tension suitable to each of the fabric characteristics may be obtained.

What is claimed is:

1. A method for automatically adjusting tension of a thread passing to a needle in a sewing machine having a drive motor operatively connected to a needle bar carrying a needle which is vertically reciprocated to penetrate a fabric to be sewn, thread tension means operated in ony way to increase tension of the thread and operated in the other way to decrease tension of the thread extended to said needle, and a microcomputer including a read only memory for storing a plurality of thread tension control data each being specific to fabrics of different thicknesses and different hardnesses, and a random access memory for temporarily storing variable load signals, the method comprising the steps of:

(a) detecting changes of a load applied to said needle bar when the needle penetrates the fabric;

(b) converting the detected changes of the load into a data representing a property of said fabric;

(c) storing said fabric property-representing data in said random access memory;

(d) reading out from said read only memory a new thread tension control data which corresponds to said fabric property representing data; and (e) comparing said read out new thread tension control data with a data representing a present value of tension applied to said thread and causing the thread tension means to be operated in said one or other way in dependence upon the value of said thread tension control data until said value of said new thread tension control data is reached.

2. A method as claimed in claim 1, wherein current waves are caused when the needle penetrates the fabric to be sewn, said detecting step including detecting changing components of said current waves.

3. The method as defined in claim 1, wherein said detecting step includes detecting a differential signal between a designated rotation speed and an actual rotation speed of the drive motor, said differential signal being obtained when said needle penetrates said fabric.

4. The method as defined claim 1, wherein said detecting step includes detecting a strain which may be applied to the needle bar when the needle penetrates said fabric.

* * * * *